252-99 AU 166 EX
5/20/80 4,203,858

United States Patent [19]
Chakrabarti

[11] 4,203,858
[45] May 20, 1980

[54] PHOSPHATE-FREE MACHINE DISHWASHING COMPOSITION

[75] Inventor: Paritosh M. Chakrabarti, Wayne, N.J.

[73] Assignee: GAF Corporation, New York, N.Y.

[21] Appl. No.: 842,482

[22] Filed: Oct. 17, 1977

Related U.S. Application Data

[63] Continuation of Ser. No. 691,008, May 28, 1976, abandoned, which is a continuation-in-part of Ser. No. 448,518, Mar. 6, 1974, abandoned.

[51] Int. Cl.[2] ..... C11D 3/08; C11D 3/10; C11D 7/26

[52] U.S. Cl. ..... 252/135; 252/99; 252/174.14; 252/174.21; 252/174.24; 252/DIG. 2; 252/DIG. 11

[58] Field of Search ..... 252/DIG. 2, DIG. 11, 252/89, 99, 135, 174.14, 174.21, 174.24

[56] References Cited

U.S. PATENT DOCUMENTS

| | | | |
|---|---|---|---|
| 3,579,455 | 5/1971 | Sabatelli et al. | 252/135 |
| 3,627,686 | 12/1971 | Sabatelli et al. | 252/527 |
| 3,700,599 | 10/1972 | Mizuno et al. | 252/99 |
| 3,764,559 | 10/1973 | Mizuno et al. | 252/99 |
| 3,850,852 | 11/1974 | Neillie et al. | 252/536 |
| 3,896,056 | 7/1975 | Benjamin et al. | 252/539 |
| 3,904,685 | 9/1975 | Shahidi et al. | 260/537 N |
| 3,922,230 | 11/1975 | Lamberti et al. | 252/89 |

*Primary Examiner*—P. E. Willis, Jr.
*Attorney, Agent, or Firm*—Walter C. Kehm; James Magee; Sheldon Parker

[57] ABSTRACT

A low-foaming machine dishwashing composition comprising (1) an alkali metal, or ammonium, carbonate and (2) a water soluble salt of a polyelectrolyte having an average molecular weight of about 500-4000 and the formula:

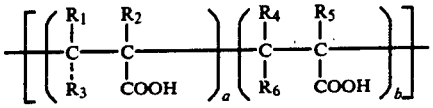

wherein $R_1$, $R_2$, $R_4$, and $R_5$ can be hydrogen, $C_1$–$C_4$ lower alkyl, or a combination thereof; $R_3$ and $R_6$ can be hydrogen, carboxy, or alkylcarboxy; and the sum of (a+b) is $\geqq 5$ to $\leqq 30$, preferably $\geqq 7$ to $\leqq 15$, employed in a weight ratio (polyelectrolyte:carbonate) of 5:95–20:80, and, preferably, a low foaming surfactant, results in effective and economical dishwashing.

7 Claims, No Drawings

PHOSPHATE-FREE MACHINE DISHWASHING COMPOSITION

CROSS-REFERENCE TO RELATED APPLICATIONS

This is a continuation of application Ser. No. 691,008, filed May 28, 1976 which is in turn a continuation-in-part of application Ser. No. 448,518 filed Mar. 6, 1974, both abandoned.

BACKGROUND OF THE INVENTION

1. Field of the Invention

This invention relates to a phosphate-free machine dishwashing composition. More particularly, this invention relates to a machine dishwashing composition which is free from phosphorus and which more efficiently removes food soils from cooking and eating utensils with less spotting and at least equivalent clarity to glassware and dishes when compared to conventional phosphate-built dishwashing compositions.

Mounting legislation outlawing the use of phosphorus in all household detergents has created considerable demand for phosphorus-free machine dishwashing compositions. However, despite significant efforts, no fully satisfactory phosphate-free machine dishwashing composition has, as yet, been obtained that is now commercially available.

In the detergent industry, distinctions are drawn between cleaning compositions on the basis of their functional utility; for example, those in the art are well aware that there are considerable art-recognized differences between cleaning compositions that are used for laundering purposes; cleaning compositions that are used for machine dishwashing purposes; and cleaning compositions that are used for hand dishwashing purposes. Generally, cleaning compositions for laundering purposes employ high foaming organic surfactants as the main cleansing agents. Foaming, unless it is excessive to the extent that it causes overflow from the washing machines, is generally considered beneficial in laundering compositions since it helps to loosen the soil from the fabric substrates by its local mechanical action. This local action is desirable since the substrate in the laundry machine receives comparatively poor mechanical agitation. By way of contrast, machine dishwashing methods that are currently used to wash china, glass, porcelain, ceramics, metal, and hard synthetic articles result in there being a high mechanical impact of the wash liquid that is sprayed onto the articles to be cleaned. Recently, developments in dishwashing apparatus have been directed toward further increasing the intensity of liquid motion as well as the water volume cycled per minute, and in this way to further improve the mechanical cleansing effect of the cleansing solution. Compared to laundering compositions, however, machine dishwashing compositions are very low-foaming compositions and preferably so, since foam formation reduces the mechanical impact of the liquid sprayed onto the articles to be cleaned. The surface active agents useful for machine dishwashing compositions should not only be low foaming materials in and of themselves, but they should also preferably be foam depressants, so that the foaming caused by protein and food residues in combination with alkaline cleansing solutions is kept to a minimum. Accordingly, the surfactant content of machine dishwashing compositions is very low. This situation, however, is quite different from hand dishwashing compositions, which, preferably, are high foaming and have more the attributes of laundering compositions.

2. Description of the Prior Art

Heretofore, the machine dishwashing detergent compositions that have been commercially employed in the art have been based on the use of phosphorus compounds that are now strenuously objected to on ecological grounds. For example, U.S. Pat. Nos. 3,579,455 and 3,627,686 require, respectively, the presence of tetra(alkali metal) pyrophosphate and an alkali metal hexametaphosphate, or the presence of tetra(alkali metal) pyrophosphate and alkali metal nitrilotriacetate.

In order to circumvent the phosphate requirements of the foregoing patents, later patents such as those of U.S. Pat. Nos. 3,700,599 and of 3,706,672 have found need to resort to the use of polymeric chelating agents per se (U.S. Pat. No. 3,700,599), or of such chelating agents in combination with an alkaline detergent salt or salts (U.S. Pat. No. 3,706,672). However, the amount of the polymer that is used in these patents is directly controlled by the degree of hardness of the water in which the dishwashing composition is to be utilized; for such amount has to be sufficient for purposes of chelating both the calcium and magnesium ions that are present. Thus, the primary function of the maleic anhydride/vinyl acetate copolymer of these latter two patents is to soften the water in which the dishes, glassware, etc. are to be washed by sequestering those metal cations which cause the hardness of such water. But this requires, for relatively hard water having 300 ppm or higher of those cations causing such water to be hard, a high polymeric or polyelectrolytic concentration to be present in the composition of the ultimate dishwashing product that is employed.

Use of strong chelating agents, however, such as the hardness sequestering polyelectrolytes discussed above as well as those now known and available to the art, pose, from an ecological standpoint, long range and unknown potential toxicological sources of danger. For example, strong sequestrants such as nitrilotriacetate, sodium oxydiacetate, etc., have been shown to be ecologically unacceptable owing to their potential toxicity; for it is said that these sequestrants can complex with heavy metals such as $Hg^{++}$ and other trace heavy metals and offset the biological transport mechanism of these trace metals in living tissues. Thus, nitrilotriacetate has been blamed for causing fetus abnormality by a similar mechanism. By way of contrast, however, inefficient metal complexing agents are free from this drawback and this is believed to be the case with the polyelectrolytes contained in the present machine dishwashing compositions.

Contemporary ecological considerations, moreover, in another germane aspect, require that such formulated products as machine dishwashing compositions be at least 90% biodegradable. However, past and present machine dishwashing compositions now available to, and known in and by, the art, in order to be effective, must contain more than 10% polyelectrolytes and as such would not meet the stringent ecological requirements. Furthermore, high molecular weight polyelectrolytes such as those now used in the art are known to be biorefractory.

By way of contrast, and in resolution of the foregoing art-recognized deficiencies and needs, the present invention now provides a machine dishwashing composition that is able to function satisfactorily with low polyelectrolyte concentrations, i.e., polyelectrolyte concentrations so low as to fall far short of the amounts required to sequester the metal cations that cause the hardness of the water present in the wash solution. In fact, the most effective polyelectrolytes of the present invention are characterized by such low molecular weights and such a low degree of polymerization that they would be regarded as poor prospective candidates as sequestering agents consistent with the needs and requirements of U.S. Pat. Nos. 3,700,599 and 3,706,672. It has been found, by the present invention, that the select use of certain polyelectrolytes of a specific character and description in combination with an alkali metal, or ammonium, carbonate, whereby the weight ratio of polyelectrolyte to carbonate is kept within controlled limits, enables the resultant dishwashing composition, which comprises those two materials as essential ingredients, not only to function at least as efficiently and effectively as previous dishwashing compositions (such as those discussed above), but also to be operable (with less cost of manufacture) with polyelectrolyte levels previously found to be inoperable by the prior art.

In conclusion, it can be stated that there are two major differences between the present non-phosphate machine dishwashing compositions and those low- or non-phosphate polyelectrolyte-built machine dishwashing compositions that have been heretofore known or used in the machine dishwashing art, and these differences can be briefly summarized as follows:

(1) the present machine dishwashing compositions employ low concentrations of polyelectrolytes, whereas those of the prior art utilize high concentrations of polyelectrolytes.

(2) the present machine dishwashing compositions employ polyelectrolytes of low molecular weight which have very poor metal ion sequestering capacity, whereas those of the prior art utilize polyelectrolytes that are strong sequestrants for metal ions.

As has been seen, these two major differences to at least a substantial extent are believed tied to the surprising ecological advantages that accrue to the present machine dishwashing compositions vis-a-vis those of the prior art. As but a simple illustration of this, it can be noted that the present compositions comprise mostly inorganic salts such as an alkali metal, or ammonium, carbonate and contain less than 10% polyelectrolytes of low molecular weight, and this enables the resultant or ultimate machine dishwashing composition or product to be at least 90% biodegradable, even in the event the polyelectrolytes thereof may be biorefractory.

SUMMARY OF THE INVENTION

The present invention relates generally to phosphate-free, low foaming machine dishwashing compositions comprising an admixture of an alkali metal, or ammonium, carbonate and a water soluble salt of a low molecular weight polymer, and more particularly relates to a phosphate-free, low foaming machine dishwashing composition comprising an admixture of an alkali metal, or ammonium, carbonate and a water soluble salt of a low molecular weight polyelectrolyte such as a polyacrylate or polymethacrylate having a molecular weight of about 500–4000 and the formula:

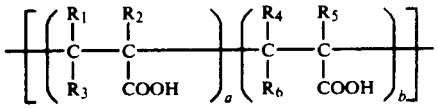

wherein $R_1$, $R_2$, $R_4$, and $R_5$ can be hydrogen, $C_1$–$C_4$ lower alkyl, or combinations thereof; $R_3$ and $R_6$ can be hydrogen, carboxy, alkylcarboxy or a combination thereof; and the sum of (a+b) is $\geqq 5$ to $\leqq 30$, preferably $\geqq 7$ to $\leqq 15$, employed in a weight ratio (polyelectrolyte:carbonate) of 5:95–20:80, and preferably with a low-foaming surfactant and/or other conventional additives or ingredients, results in effective and economical dishwashing.

DESCRIPTION OF THE PREFERRED EMBODIMENTS

The phosphate-free, low foaming machine dishwashing compositions of the present invention comprise, as noted previously:

(i) an alkali metal, or ammonium, carbonate. Typical of the alkali metal or ammonium carbonates which can be employed in the compositions of the present invention are the alkali metal, ammonium or substituted ammonium, carbonates; bicarbonates; sesquicarbonates; and mixtures thereof. Illustrative of such carbonates are lithium carbonate, sodium carbonate, potassium carbonate, ammonium carbonate, potassium bicarbonate, potassium bicarbonate, sodium sesquicarbonate, potassium sesquicarbonate, and mixtures thereof. The preferred alkali metal carbonate is sodium carbonate.

(ii) a water soluble salt of a low molecular weight polyelectrolyte having the structure formula:

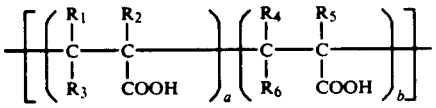

wherein $R_1$, $R_2$, $R_4$, and $R_5$ can be hydrogen, $C_1$–$C_4$ lower alkyl, or combinations thereof; $R_3$ and $R_6$ can be hydrogen, carboxy, lower alkoxycarboxyl, or a combination thereof; and the sum of (a+b) is $\geqq 5$ to $\leqq 30$, preferably $\geqq 7$ to $\leqq 15$, the weight ratio of polyelectrolyte:carbonate being 5:95–20:80, the molecular weight of said polyelectrolyte being about 500–4000. Typical of the polyelectrolytes encompassed copolymers of acrylic acid, methacrylic acid, maleic acid, fumaric acid, itaconic acid, etc. Preferably, the polyelectrolyte is a polyacrylic acid, polymethacrylic acid, or a copolymer of acrylic and methacrylic acids, said homopolymers and copolymer ranging in molecular weight from about 504 to 1291 when they contain the preferred 7 to 15 monomeric units per molecule.

The polyelectrolytes that can be employed in the present invention include polyelectrolytes exhibiting a low molecular weight such as those having molecular weights of from about 500 to about 4000.

The preferred low molecular weight polymeric polyelectrolytes of the present invention can be prepared by conventional methods of polymerization of vinyl monomers in the presence of a chain transfer agent, the function of the latter being to control the chain length of the polymer. Although any chain transfer agent can be suitably employed, the preferred chain transfer agents are the mercapto(-SH) bearing compounds such as alkyl mercaptans, mercapto acids, thio acids, inorganic thio compounds, and the like.

The water soluble salts of the polyelectrolytes described above can be the alkali metal salts or the ammonium or substituted ammonium salts thereof.

The alkali metal carbonate and water soluble salt of the polyelectrolyte which together form the essential ingredients of the low-foaming machine dishwashing composition of the present invention can be combined, as noted, in a weight ratio (polyelectrolyte:carbonate) of from about 5:95 to about 20:80.

The phosphate-free machine dishwashing compositions of the present invention can also optionally include the following:

(a) Up to about 5% by weight of a foam-suppressing non-ionic surfactant. Illustrative of such surfactants are the modified ethyoxylated alcohol or alkyl phenol type, wherein the ethoxylate is modified by replacing the terminal OH group with halogen, for example, chlorine, or alkoxy, or with aryloxy and arylalkyloxy groups; amine polyglycol condensates; pluronic surfactants obtained by the condensation of ethylene oxide with hydrophobic bases formed by condensing propylene oxide with propylene glycol, and the like. Typical of such surfactants are: Antarox BL-225 and BL-330, Antarox LF-330 and LF-334 available from GAF Corporation; Plurofac RA43, Plurofac RA435, available from Wyandotte Chemical Corporation; Tergitol Min-Foam 1X and 2X from Union Carbide Corporation; and Triton CF10, CF21, CF54, DF12, DF16, available from Rohm & Haas Company.

(b) Up to 50% by weight of an alkali metal silicate. The alkali metal silicates which can be employed in the composition of the present invention can range from the metasilicates, which are often designated as 1:1 $M_2O$:-$SiO_2$ silicates to low $M_2O$:$SiO_2$ silicates such as 3.2:1 silicates, where $M_2O$ represents the alkali metal oxide portion of the silicate. The preferred alkali metal silicates are sodium and not essential ingredients of the composition of this invention but although optional, their presence is, however, beneficial to the composition, particularly when corrosion inhibition of metal parts is desired. Thus, an institutional dishwashing composition to be used for washing glassware and china only, a composition free from the silicates can be suitably employed. In such cases, however, some free caustic such as sodium hydroxide or potassium hydroxide can be beneficially employed in place of the silicates to impart higher alkali reserves to the composition. In a household machine dishwashing composition, however, where silverware, aluminum pots and pans and other metal utensils are washed along with china and glassware, a silicate based composition is preferred. For optimum corrosion inhibition, the composition of the present invention preferably contains from about 6 to about 10% by weight $SiO_2$ derived from the silicate.

(c) Up to about 80% by weight of an inert diluent such as alkali metal chlorides, sulfates, nitrites, and the like. Illustrative of such diluents are sodium or potassium chloride, sodium or potassium sulfate, sodium or potassium nitrite, and the like.

Additionally, small amounts of other conventional additives such as perfumes, colorants, chlorinated bleaches, antibacterial agents, or other similar adjuvants can be suitably employed.

The machine dishwashing composition of the present invention can be stored and used as either a dry mixture of the above composition or a concentrated solution of the above composition in admixture with from about 20 to 80% water. Preferably, liquid concentrates of the machine dishwashing composition of the present invention contain from about 40 to about 80% water.

The alkaline, phosphate-free, low-foaming machine dishwashing composition of the present invention is highly effective in removing food soils and residues from dishes, glassware and other cooking and eating utensils when employed in conventional dishwashing machines as an aqueous solution containing from about 0.05 to about 0.5 weight % and preferably, from about 0.1 to about 0.3 weight % of the machine dishwashing composition of the present invention at a temperature of from about 70° to about 200° F. and preferably from about 130° to about 160° F. and applying said aqueous solution at said temperatures to the surfaces to be cleaned under conditions which effect a high mechanical impact of the aqueous solution on said surfaces to be cleaned. Although any technique can be employed for applying the aqueous solution of the dishwashing composition to the fouled surfaces, it has been found especially highly effective when used with spray washing equipment of the type conventionally used in cleaning cooking and eating utensils. Additionally, highly effective cleaning with low foaming can be obtained in institutional dishwashing machines when employing the composition of the present invention. In the final step of the cleaning process, the clean surfaces are preferably rinsed with clear water. It has been found, in accordance with the present invention, that not only are the food residues more effectively removed with the composition of the present invention, but the cleaned dishes and glassware exhibit less spotting and greater clarity than conventional cleaning compositions.

The following examples further illustrate the machine dishwashing compositions and the dishwashing process of the present invention. Unless otherwise stated, all percentages and parts are by weight.

EXAMPLES 1-17

One important aspect of a dishwashing detergent's performance is its ability to retard or prevent formation of spots or films on dishes and glassware. Spotting generally occurs by deposition of insoluble inorganic salts. Deposit formation also interferes with the operation of the washing equipment, requiring frequent maintenance. A deposition tendency test was thus employed in which the dishwashing composition was dissolved in 300 ppm hard water (Ca:Mg=60:40) to give a 0.15% solution, the solution was heated to 140° F. and held there with magnetic stirring for 30 minutes. The solution at different intervals of time was then examined for appearance of haze, cloudiness, or precipitation. Non-appearance of precipitation within 10 minutes at 140° F. was considered to be satisfactory. Results of such tests are shown in Table 1. These results indicate that low molecular weight polyelectrolytes are superior to high molecular weight polyelectrolytes in the composition of the present invention and both are superior to the control which did not contain any polyelectrolytes.

Table 1

| Example No. | Polyelectrolyte[1] Average MW | Composition, % by Weight: Polyelectrolyte Sodium Salt | $Na_2CO_3$ | $Na_2SiO_3 \cdot 5H_2O$ | Surf.[2] | $Na_2SO_4$ | Ratings[3]: 10 min. 80° F. | 0 min. 140° F. | 10 min. 140° F. | 30 min. 140° F. |
|---|---|---|---|---|---|---|---|---|---|---|
| 1 | — | — | 33 | 33 | 2 | 32 | D | D | D | D |
| 2 | Poly AA $\overline{450}$[4] | 7 | 33 | 33 | 2 | 25 | A | B | C | D |
| 3 | Poly AA $\overline{850}$ | 5 | 33 | 33 | 2 | 27 | A | A | A | B |
| 4 | Same | 7 | 33 | 33 | 2 | 25 | A | A | A | A |
| 5 | Same | 10 | 88 | — | 2 | — | A | A | A | C |
| 6 | Poly AA $\overline{1150}$ | 5 | 33 | 33 | 2 | 27 | A | A | A | B |
| 7 | Same | 7 | 33 | 33 | 2 | 25 | A | A | A | B |
| 8 | Poly AA $\overline{1550}$ | 5 | 33 | 33 | 2 | 27 | A | A | C | D |
| 9 | Poly AA $\overline{1550}$ | 7 | 33 | 33 | 2 | 25 | A | A | C | C |
| 10 | Poly AA 4000 | 7 | 33 | 33 | 2 | 25 | A | A/B | C | D |
| 11 | Copoly(1:5 MeA-MAA)$\overline{1000}$ | 7 | 33 | 33 | 2 | 25 | A | A | B | B |
| 12 | Poly MAA $\overline{950}$ | 5 | 33 | 33 | 2 | 27 | A | A | A | B |
| 13 | Poly MAA $\overline{1450}$ | 5 | 33 | 33 | 2 | 27 | A | A | A | B |
| 14 | Poly MeA $\overline{1850}$ | 5 | 33 | 33 | 2 | 27 | A | A | B | C |
| 15 | Copoly(1:1 MAA-AA)$\overline{950}$ | 5 | 33 | 33 | 2 | 27 | A | A | B | B |
| 16 | Poly AA 25,000 | 7 | 33 | 33 | 2 | 25 | A | D | D | D |
| 17 | Same | 10 | 33 | 33 | 2 | 22 | A | C | C/D | D |

[1]AA = Acrylic Acid; MeA = Methyl Acrylate; MAA = Methacrylic Acid;
[2]Surface active agent used was Antarox BL-225 (available from GAF Corporation)
[3]A = Clear or very slight haze; B = Hazy or very slightly Cloudy; C = Cloudy; D = Precipitation.
[4]$\overline{450}$ = ave. molecular weight of 450, etc.

EXAMPLES 18-21

These examples compare the results obtained with machine dishwashing compositions of the present invention with those obtained with a phosphate-built dishwashing composition.

Evaluations were conducted following Procedure No. 198 described in the Chemical Specialties Manufacturers Assoc., Inc. Bulletin dated July 31, 1957 (A Tentative Spotting and Filming Test in Home Dishwashing Machines). Results of such evaluations are shown in Table 2.

As may be noted from the results, the compositions of the present invention are far superior to the controls with or without phosphate.

Table 2

Evaluation of Automatic Dishwasher Detergents for Filming and Spotting Characteristics Test Conditions Water Temperature: Initial 120° F. - Final 140° F.; Water Hardness 300 ppm (Ca:Mg = 60:40) as $CaCO_3$.
Soil = 20% dried milk/80% margarine (total 40 g.)
Load = 6 glass tumblers
Dishwasher: Kitchen Aid KD15
Detergent Conc.: 0.35% (Total 28.0 g.)

| Example No. | Composition, % by Weight: $Na_2CO_3$ | STPP[5] | NaPAA-850[1] | $Na_2SiO_3 \cdot 5H_2O$ | Surf.[2] | CDB-63[3] | $Na_2SO_4$ | Number of Wash Cycles[4]: 1 | 2 | 3 | 4 | 5 | 6 |
|---|---|---|---|---|---|---|---|---|---|---|---|---|---|
| 18 | 30 | — | — | 33.5 | 2 | 2 | 32.5 | 2a | 2b | 2c | 2d | 5e | 5e |
| 19 | 30 | — | 7.5 | 33.5 | 2 | 2 | 25 | 1a | 1a | 1.3a | 2.2a | 2.7a | 3.2a |
| 20 | 84.7 | — | 10 | — | 2.7 | 2.6 | — | 1a | 1.5a | 1.7a | 2.2a | — | — |
| 21 | 30 | 32.5 | — | 33.5 | 2 | 2 | — | 1a | 2a | 2.6a | 3.2a | 3.2a | 3.5a |

[1]Sodium polyacrylate of average $\overline{MW}$ 850, the MW being on the free acid.
[2]The surfactant used was Antarox BL 225.
[3]Chlorinated Cyanuric Acid Bleach (sodium dichloroisocyanurate) from FMC Corp.
[4]Rating Codes:
1 - No spots
2 - 15 spots or less
3 - 15 to 30 spots
4 - 30 to 60 spots
5 - More than 60 spots
a - No film
b - Very slight film
c - Slight film
d - Moderate film
e - Exteme film
[5]Sodium tripolyphosphate

EXAMPLES 22-27

The following examples show that when properly built with an alkali metal silicate, the compositions of the present invention do not corrode aluminum.

Corrosion tests were run according to the procedure set forth in Interim Federal Specification No. P-D-00425 d (GSA-FSS) of June 17, 1968 for Machine Dishwashing Compounds.

First, a stock solution of the detergent composition was prepared as follows: the composition (50 g.) was dissolved in $CO_2$-free distilled water at 55°-65° C. The solution was cooled to 20°±1° C., and diluted exactly to 1 liter with water.

Corrosion tests were run on aluminum strips with the above solutions at two dilution levels—I and II. Dilution level I was obtained by diluting 18.75 ml. of the stock solution to 250 ml. with distilled water. Dilution level II, was obtained by diluting 13.13 ml. of the stock solution to 250 ml. with distilled water. Specimens (approximately 3 inches by 0.75 by 0.064 inch) of bright-finished uncoated aluminum alloy sheet (Aluminum Alloy 3003), conforming to temper H14 of QQ-A-250/2 were totally immersed in 250 ml. each of the diluted stock solutions at 82° C. (180° F.) for 5 hours. The solution levels were maintained with distilled water during the experiment. After 5 hours' exposure, the specimens were removed, rinsed with distilled water and dried. They were then examined for corrosion or etching by weight loss, for discoloration and for formation of a white film on the surface. Results are shown in Table 3. As can be seen from these results, alkali metal silicates are necessary in the composition of the present invention if corrosion inhibition of metals is desired.

Table 3

| Example No. | Type of Sodium Silicate $SiO_2$:$Na_2O$ | Composition, & Weight: Silicate as is | Silicate as $SiO_2$ | $Na_2CO_3$ | NaPAA(2) $\overline{850}$ | Surf.(3) | CDB-63(4) | $Na_2SO_4$ | Dilution Level | Ratings: % Wt. Loss | Discoloration | White film |
|---|---|---|---|---|---|---|---|---|---|---|---|---|
| 22 | — | — | — | 35 | 7.5 | 2 | 2 | 53.5 | I | 1.3 | Yes | No |
| 23 | — | — | — | 35 | 7.5 | 2 | 2 | 53.5 | II | 1.1 | Yes | No |
| 24 | 1:1($Na_2SiO_3 \cdot 5H_2O$) | 35 | 9.8 | 35 | 7.5 | 2 | 2 | 18.5 | I | 0 | No | No |
| 25 | Same | 35(1) | 9.8 | 35 | 7.5 | 2 | 2 | 18.5 | II | 0.1 | No | No |
| 26 | 2.5:1 | 18(1) | 9.4 | 35 | 7.5 | 2 | 2 | 35.5 | I | 0 | No | No |
| 27 | Same | 18 | 9.4 | 35 | 7.5 | 2 | 2 | 35.5 | II | 0 | No | No |

(1)Expressed as solid 2.5:1 $SiO_2$:$Na_2O$ silicate (2)Sodium polyacrylate of average $\overline{MW}$ 850, the molecular weight being expressed on the free acid (3)Surfactant used was Antarox BL 225 from GAF Corporation (4)Chlorinated Cyanuric Acid Bleach from FMC

What is claimed is:

1. A phosphate-free, low foaming, machine dishwashing composition consisting essentially of, approximately by weight,:

(i) an alkali metal or ammonium carbonate;

(ii) a water soluble salt of a polyelectrolyte, selected from the group consisting of polyacrylic acid, polymethacrylic acid and their copolymers with each other, having a molecular weight of about 504 to 1291, the weight ratio of (ii):(i) ranging from about 5:95 to about 20:80;

(iii) 0 to about 10% of a foam-suppressing non-ionic surfactant;

(iv) 0 to about 50% of an alkali metal silicate; and (v) 0 to about 80% of an inert diluent selected from the group consisting of alkali metal chlorides, sulfates and nitrites.

2. A phosphate-free, low-foaming, machine dishwashing composition according to claim 1 wherein said carbonate is sodium carbonate.

3. A composition as defined in claim 1 wherein said polyelectrolyte is polyacrylic acid.

4. A composition as defined in claim 1 containing finite amounts of (iii), (iv) and (v).

5. A phosphate-free, low-foaming, machine dishwashing composition according to claim 2 wherein said polyelectrolyte is polyacrylic acid having a molecular weight of abcut 850.

6. In a process for removing food soils and residues from cooking and eating utensils in a dishwashing machine, the improvement comprising applying to said cooking and eating utensils an aqueous solution containing from about 0.05 to about 0.5 weight % of the phosphate-free, low-foaming, machine dishwashing composition as defined in claim 1 at a temperature of from about 70° to about 200° F. under conditions which effect mechanical impact of the aqueous solution with said utensils, and thereafter rinsing said utensils with clear water.

7. A process as defined in claim 6 wherein said polyelectrolyte is polyacrylic acid.

* * * * *